United States Patent [19]

Uchiyama et al.

[11] Patent Number: 4,881,659

[45] Date of Patent: Nov. 21, 1989

[54] GOVERNOR CAP SEALING STRUCTURE OF TRANSMISSION GEARBOX

[75] Inventors: Hirao Uchiyama, Yokohama; Hiromi Taguchi, Zama, both of Japan

[73] Assignee: Nissan Motor Co., Ltd., Yokohama, Japan

[21] Appl. No.: 221,359

[22] Filed: Jul. 19, 1988

[30] Foreign Application Priority Data

Jul. 23, 1987 [JP] Japan ..... 62-111855[U]

[51] Int. Cl.[4] ..... B65D 45/32

[52] U.S. Cl. ..... 220/319; 220/324; 220/378; 137/382

[58] Field of Search ..... 220/295, 304, 308, 310, 220/357, 358, 378, 319, 320, 324; 137/382

[56] References Cited

U.S. PATENT DOCUMENTS

| | | | |
|---|---|---|---|
| 2,772,016 | 11/1956 | Bristol | 220/358 X |
| 4,248,262 | 2/1981 | Iwanaga | 220/319 X |
| 4,267,940 | 5/1981 | Wade | 220/378 X |
| 4,712,708 | 12/1987 | Taguchi | 220/319 |

*Primary Examiner*—Stephen Marcus
*Assistant Examiner*—Nova Stucker
*Attorney, Agent, or Firm*—Foley & Lardner, Schwartz, Jeffery, Schwaab, Mack, Blumenthal & Evans

[57] ABSTRACT

A governor cap sealing structure of a transmission gearbox, in which a governor cap for covering a governor valve arranged outside the transmission gearbox is mounted to a mount member attached to the outside of the transmission gearbox via a sealing member interposed between the governor cap and a sealing surface of the mount member, and in which the width of the sealing surface of the mount member is larger than that of the sealing member.

3 Claims, 1 Drawing Sheet

GOVERNOR CAP SEALING STRUCTURE OF TRANSMISSION GEARBOX

BACKGROUND OF THE INVENTION

1. Field of the Invention

The present invention relates to a governor cap sealing structure of a transmission gearbox.

2. Description of the Prior Art

In a conventional automatic transmission gearbox, as shown in FIGS. 1 and 2, a governor valve 1 for producing a pressure signal corresponding to an automobile speed is connected to and is rotated by an output shaft of the transmission gearbox through a pair of gears 2*a* and 2*b* and a governor shaft 3 to produce a governor pressure corresponding to the automobile speed. The governor valve 1 is normally arranged outside a transmission case 4, and a governor cap 5 is required to cover the governor valve 1 in order to prevent the oil flowing out of the governor valve 1 from the scattering in all directions during the rotation thereof. Hence, the governor cap 5 is mounted to a mount member 7 attached to the outside of the transmission case 4 through a sealing ring 6, which is made of a resilient material such as rubber, interposed therebetween for sealing the space between the governor cap 5 and the mount member 7, as hereinafter described in detail.

In a conventional governor cap sealing structure employed in an automatic Trans-axle (Trade Name), as shown in FIG. 2, the governor cap 5 includes a shoulder portion 5*a*, a cylindrical portion 5*b* and a bottom portion 5*c*, and the mount member 7 includes an outer sealing surface 7*a*, an intermediate flange portion 7*b* projecting outward, and an end surface 7*c*. The sealing ring 6 is correctly fitted in a sealing space 8 defined by the shoulder portion 5*a* of the governor cap 5 and the outer sealing surface 7*a* of the mount member 7, and the governor cap 5 is prevented from its falling from the mount member 7 by a clip 9 attached to the bottom portion 5*c* of the governor cap 5.

In this embodiment, however, the width of the outer sealing surface 7*a* of the mount member 7 is smaller than that of the sealing ring 6, and hence, even when the sealing ring 6 is exactly arranged in the sealing space 8, the sealing ring 6 partially protrudes beyond the end surface 7*c* of the mount member 7. Further, when the sealing ring 6 is insufficiently or incompletely fitted in the sealing space 8, as shown by the sealing ring 6*a* indicated by the one-dotted line in FIG. 2, it is liable to misunderstand such an insufficient or incomplete arrangement of the sealing ring 6 for the correct fitting. Then, when the governor cap 5 is mounted to the mount member 7 while the sealing ring 6 is insufficiently or incompletely fitted in the sealing space 8, the sealing ring 6 is caught by the shoulder portion 5*a* of the governor cap 5 and the end surface 7*c* of the mount member 7, and is deformed thereby, resulting in a cause of a problem such as an oil leakage.

SUMMARY OF THE INVENTION

Accordingly, it is an object of the present invention to provide a governor cap sealing structure of a transmission gearbox, free from the aforementioned disadvantages and defects of the prior art, which is capable of preventing an improper or imcomplete arrangement of a sealing member between the governor cap and a mount member, and an oil leakage caused thereby.

In accordance with one aspect of the present invention, there is provided a governor cap sealing structure of a transmission gearbox, comprising a governor cap for covering a governor valve arranged outside the transmission gearbox, a mount member having a sealing surface, attached to the outside of the transmission gearbox, and a sealing member arranged between the governor cap and the sealing surface of the mount member when the governor cap is mounted to the mount member, a width of the sealing surface of the mount member being larger than that of the sealing member.

DESCRIPTION OF THE PREFERRED EMBODIMENT

Figure 2:
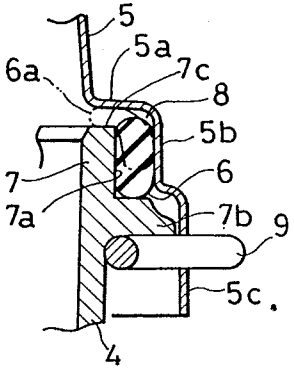
FIG.2 (PRIOR ART)
FIG. 2 is an enlarged fragmentary cross sectional view of FIG. 1, for showing a conventional governor cap sealing structure.
Figure 3:
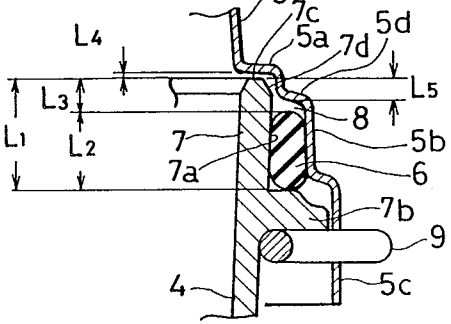
FIG. 3 is an enlarged fragmentary cross sectional view, like FIG. 2, of a governor cap sealing structure of a transmission gearbox according to the present invention.
Figure 1:
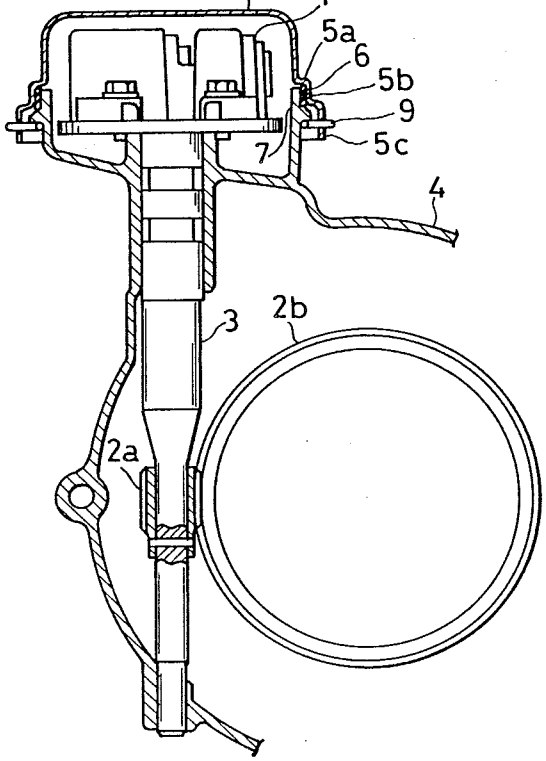
FIG.1 (PRIOR ART)
FIG. 1 is a cross sectional view of a governor drive mechanism of an automatic transmission gearbox.

Referring now to the drawing, there is shown in FIG. 3 one embodiment of a governor cap sealing structure for an automatic transmission gearbox according to the present invention.

In the drawing, a governor cap 5 is provided with a first shoulder portion 5*a*, a cylindrical portion 5*b*, a bottom portion 5*c* and a second shoulder portion 5*d* between the first shoulder portion 5*a* and the cylindrical portion 5*b*, and the first and second shoulder portions 5*a* and 5*d* are positioned approximately perpendicular to the cylindrical portion 5*b*. A mount member 7 of a transmission case 4 includes an outer sealing surface 7*a*, an intermediate flange portion 7*b* projecting outward, and an end surface 7*c* positioned approximately perpendicular to the outer sealing surface 7*a*. An outer end corner 7*d* of the mount member 7 is cut off. A sealing ring 6 is correctly arranged in a sealing space 8 defined by the cylindrical portion 5*b* of the governor cap 5 and the outer sealing surface 7*a* of the mount member 7, and the governor cap 5 is retained onto the mount member 7 by a clip 9 which is attached to the bottom portion 5*c* and contacts the inner lower surface of the flange portion 7*b* in order to prevent the governor cap 5 from falling off the mount member 7.

In this embodiment, the width $L_1$ of the outer sealing surface 7*a* of the mount member 7 is larger by a width $L_3$ than the width $L_2$ of the sealing ring 6, and a gap $L_4$ between the first shoulder portion 5*a* of the governor cap 5 and the end surface 7*c* of the mount member 7 is determined to be very small, for instance, at most 1 mm. Further, the second shoulder portion 5*d* is formed between the first shoulder portion 5*a* and the cylindrical portion 5*b* of the governor cap 5 at a distance $L_5$ ($L_5$ is smaller than $L_3$) apart from the end surface 7*c* towards the flange portion 7*b* of the mount member 7. When the governor cap 5 is mounted to the mount member 7, the cylindrical portion 5*b* of the governor cap 5 faces to the outer sealing surface 7*a* of the mount member 7 in approximately parallel thereto, and the end surface 7*c* of the mount member 7 faces to the first shoulder portion 5*a* of the governor cap 5 in approximately parallel thereto.

Hence, in this embodiment, since the width of the outer sealing surface *7a* of the mount member 7 is designed to be larger than that of the sealing ring 6, the sealing ring 6 does not project beyond the end surface *7c* of the mount member 7 as far as the sealing ring 6 is properly fitted onto the outer sealing surface *7a* of the mount member 7 or in the sealing space 8 between the governor cap 5 and the mount member 7, and the proper or sufficient fitting state of the sealing ring 6 onto the outer sealing surface *7a* of the mount member 7 can be noticed readily by visually observing whether the width $L_3$ exists or not. Therefore, although the sealing ring 6 is improperly or incompletely arranged on the outer sealing surface *7a* of the mount member 7, the misunderstanding of this improper or incomplete arrangement of the sealing ring 6 for the correct arrangement may not happen at all, thereby effectively preventing an occurrence of a bite of the sealing ring 6 between the governor cap 5 and the mount member 7 and a followed problem such as an oil leakage.

Then, even when the governor cap 5 is to be mounted to the mount member 7 while the sealing ring 6 is incompletely or insufficiently arranged on the outer sealing surface *7a* of the mount member 7, the second shoulder portion *5d* of the governor cap 5 contacts and pushes the incompletely or insufficiently arranged sealing ring 6, and hence the governor cap 5 cannot be mounted to the mount member 7 as the sealing ring 6 is arranged in such an incompletely or insufficiently fitted state.

Furthermore, even if the governor cap 5 is to be mounted to the mount member 7 as the sealing ring 6 is arranged in the incompletely or insufficiently fitted state, it is impossible to mount the governor cap 5 onto the mount member 7 because the gap $L_4$ is too small, resulting in that the mounting of the governor cap 5 onto the mount member 7 may be prevented when the sealing ring is improperly or insufficiently fitted on the outer sealing surface *7a* of the mount member 7.

What is claimed is:

1. A governor cap sealing structure of a transmission gearbox, comprising:

a governor cap for covering a governor valve arranged outside the transmission gearbox;

a mount member having a sealing surface, attached to the outside of the transmission gear box; and a sealing member arranged between the governor cap and the sealing surface of the mount member when the governor cap is mounted to the mount member, a width of the sealing surface of the mount member being larger than that of the sealing member, wherein the governor cap includes a sealing portion and first and second shoulder portions arranged approximately perpendicular to the sealing portion, the second shoulder portion being positioned closer to the sealing portion than the first shoulder portion, the mount member includes one end surface positioned approximately perpendicular to the sealing surface, the one end surface defining one end of the sealing surface, and when the governor cap is mounted to the mount member, the sealing portion of he governor cap is positioned opposite to and approximately parallel to the sealing surface of the mount member, and the one end surface of the mount member is positioned opposite to and approximately parallel to the first shoulder portion of the governor cap with a small gap therebetween.

2. The structure of claim 1, wherein the second shoulder portion of the governor cap is positioned at a distance apart from the end surface of the mount member, and the distance is smaller than the difference between the widths of the sealing member and the sealing surface of the mount member.

3. The governor cap sealing structure of claim 1, wherein the second shoulder portion is positioned between the sealing member and the one end surface of the mount member when the governor cap is mounted to the mount member.

* * * * *